United States Patent [19]

Bex

[11] 4,172,363

[45] Oct. 30, 1979

[54] HOT-GAS ENGINE

[75] Inventor: Peter T. J. Bex, Eindhoven, The Netherlands

[73] Assignee: U.S. Philips Corporation, New York, N.Y.

[21] Appl. No.: 898,631

[22] Filed: Apr. 21, 1978

[30] Foreign Application Priority Data

May 16, 1977 [NL] Netherlands ..... 7705363

[51] Int. Cl.[2] ..... F02G 1/04

[52] U.S. Cl. ..... 60/517; 92/144

[58] Field of Search ..... 60/517, 524, 525, 526; 92/144; 110/336

[56] References Cited

U.S. PATENT DOCUMENTS

| | | | |
|---|---|---|---|
| 2,463,130 | 3/1949 | Van Weenen | 92/144 |
| 3,861,146 | 1/1975 | Lynch et al. | 60/524 |

*Primary Examiner*—Allen M. Ostrager
*Assistant Examiner*—Stephen F. Husar
*Attorney, Agent, or Firm*—David R. Treacy

[57] ABSTRACT

A hot-gas engine comprising an engine part which is provided with a blanket of ceramic fibres in order to provide protection against high flame temperatures of the burner. The blanket is anchored to the engine part by means of lugs which are bent around metal wires arranged between the fibres.

3 Claims, 3 Drawing Figures

HOT-GAS ENGINE

The invention relates to a hot-gas engine, comprising at least one external burner device and at least one engine part on which an external shield of a refractory material is provided in order to protect the engine part against high flame temperatures of the burner device.

A hot-gas engine of the described kind is known from British Patent Specification No. 645,200.

The refractory shield of the known hot-gas engine consists of a dome-shaped solid block which is connected to the engine part to be protected by means of two plungers which are pressed against the walls of a cavity in the block by a spring.

This construction has a drawback in that the spring is weakened by the high operating temperature, so that the block tends to loosen.

A further drawback exists in that resistance of the solid block to temperature fluctuations is poor, notably to thermal shocks such as occur when the hot-gas engine is put into operation. As a result, the block cracks and crumbles. The pieces are then liable to shield off parts of the heater pipes in which the working medium of the engine flows to and fro. The working medium in these parts of the heater pipes is then no longer heated by the flue gases of the burner device.

Also, the solid block is heavy so that it has an adverse effect on the overall weight of the engine.

The present invention has for its object to provide an improved construction whereby the described drawbacks are eliminated.

In order to realize this object, the hot-gas engine in accordance with the invention is characterized in that the shield is formed by a blanket of ceramic fibres supported by one or more metal wire elements arranged between the fibres, said elements being anchored to the engine part by means of metal lugs which are locally bent around said elements.

Preferably, the wire-shaped elements are assembled to form an annular body comprising radial transverse connections or to form a gauze layer. This results in a stronger construction.

The invention will be described in detail hereinafter, by way of example, with reference to the accompanying diagrammatic drawing which is not to scale.

Figure 1:
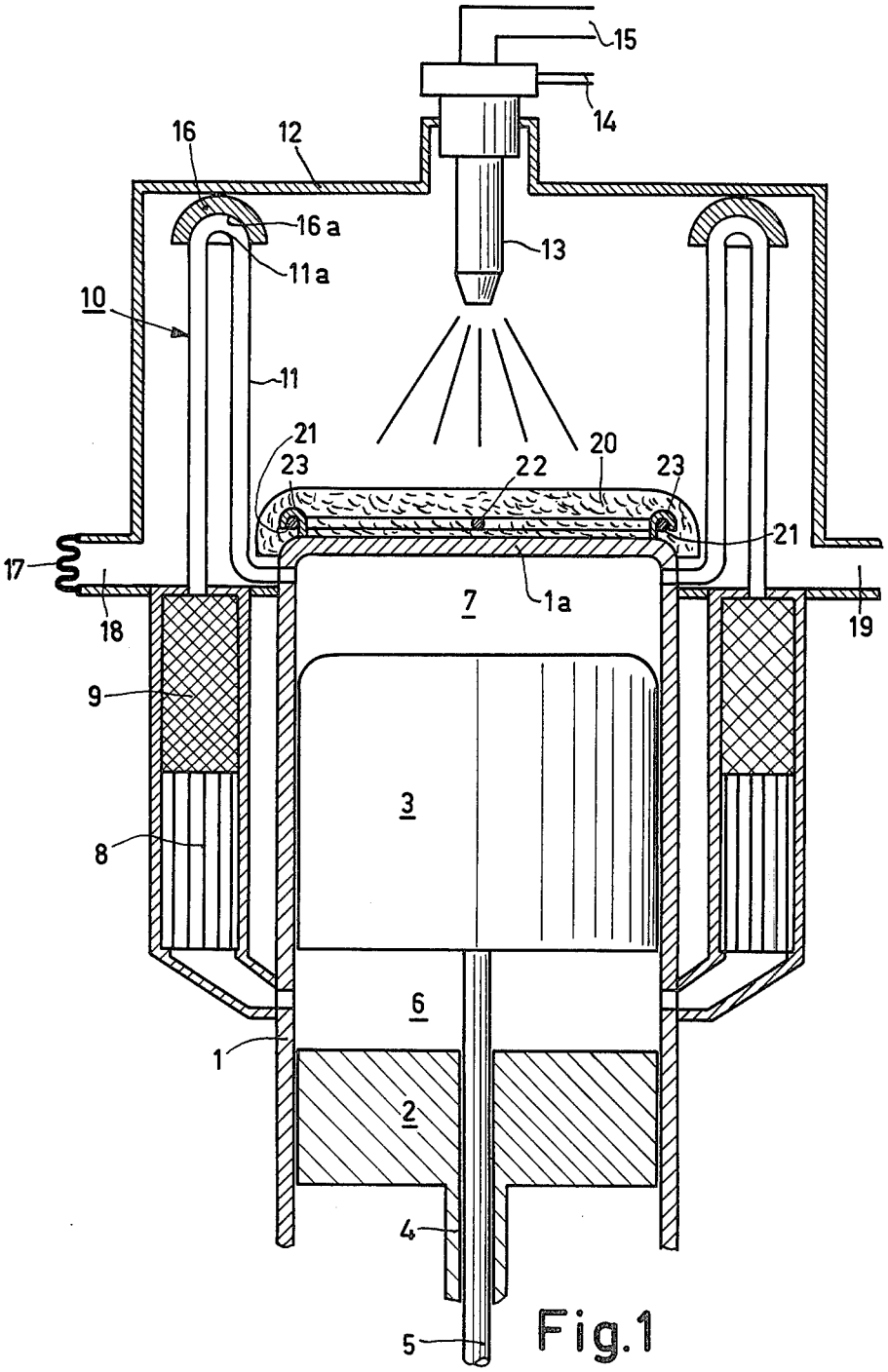

FIG. 1 is a longitudinal sectional view of a hot-gas engine in accordance with the invention.

Figure 1A:
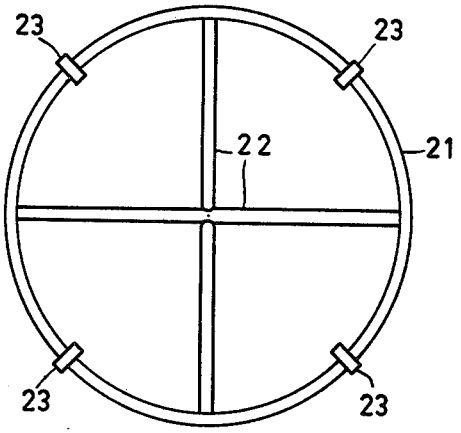

FIG. 1*a* is a plan view of an assembly of metal- wire elements as present in the refractory lining of the hot-gas engine shown in FIG. 1.

Figure 2:
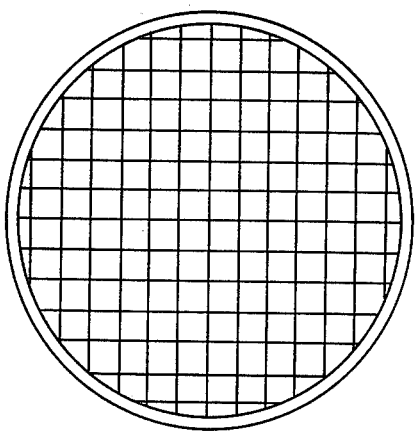

FIG. 2 shows a collection of wire elements which have been assembled to form a gauze layer.

The reference numeral 1 in FIG. 1 denotes a cylinder in which a piston 2 and a displacer 3 are arranged to reciprocate with a phase difference. The piston 2 and the displacer 3 are connected, by way of a piston rod 4 and a displacer rod 5, respectively, to a drive mechanism not shown. A compression space 6 is formed between the piston 2 and the displacer 3, whilst an expansion space 7 is present above the displacer 3. The compression space 6 and the expansion space 7 communicate with one another via a cooler 8, a regenerator 9 and a heater 10. The heater 10 is composed of a number of bent pipes 11 which are arranged in a circle and each of which opens at one end into the regenerator 9 and at the other end into the expansion space 7.

The heater 10 is accommodated in a housing 12 which supports a burner device 13 which comprises an inlet 14 for fuel and an inlet 15 for combustion air.

The upper portion of the housing 12 bears on the heater pipes 12 via a seal 16 and can follow the thermal expansion and shrinking of the heater pipes 12 due to the presence of a corrugated bellows 17 at the area of the collecting duct 18 with outlet 19 for flue gases.

The seal 16 consists of an annular element which is provided on its lower side with recesses **16*a* in which the bent heater pipe portions 11*a* accurately fit. Obviously, a variety of other seals are alternatively possible. For example, thermal insulation material can be arranged between the bent pipe portions 11*a***, said material being covered on the upper side by a semi-toroidal element.

During operation of the hot-gas engine, the flue gases originating from the burner device 13 flow along the heater pipes 11 while giving off heat thereto, and leave the housing via the outlet 19.

In order to protect the cylinder head **1*a* against the high flame temperatures of the burner device 13, a refractory shield 20 is provided on top of the cylinder head 1*a***. The shield comprises a blanket of ceramic fibres. Ceramic fibres are marketed, for example, by Imperial Chemical Industries under the registered trade marks Alumina Fiber, Zirconia Fiber, Saffil Alumina, Saffil Zirconia.

The blanket 20 contains a ring 21 with spokes 22 (see FIG. **1*a*), in this case diagonally arranged, which are made of metal wire, for example, steel wire. On the cylinder head 1*a* metal lugs 23 are secured, for example, by spot welding. The free ends of the lugs 23 are bent around the ring 21. The ring 21 with the spokes 22 and hence the blanket 20 is thus anchored to the cylinder head 1*a***.

If desired, the shield 20 can be readily removed from the cylinder head by locally removing, at the area of the lugs 23, some of the fibre material and bending back the lugs 23.

FIG. 2 shows how metal wires form a gauze layer which is one of the feasible alternatives for the ring shown in FIG. **1*a***.

Although the shield 20 is shown provided on the cylinder head in FIG. 1, similar shields can also be provided on other engine parts which are exposed to the high flame temperatures of the burner device. Such shields may be applicable, for example, to double-acting hot-gas engines having regenerator units which are to be protected.

What is claimed is:

1. A hot-gas engine, comprising at least one external burner device and at least one engine part on which an external shield of a refractory material is provided in order to protect this engine part against high flame temperatures of the burner device, characterized in that the shield is formed by a blanket of ceramic fibres supported by one or more metal wire elements arranged between the fibres, said elements being anchored to the engine part by means of metal lugs which are locally bent around said elements.

2. A hot-gas engine as claimed in claim 1, characterized in that the wire metal elements are assembled to form an annular body comprising radial transverse connections.

3. A hot-gas engine as claimed in claim 1, characterized in that the wire metal elements are assembled in the form of a gauze.

* * * * *